United States Patent [19]

Ando

[11] 4,141,610

[45] Feb. 27, 1979

[54] SHOW CASE

[76] Inventor: Shoichiro Ando, 1-3-3, Nakameguro, Meguro-ku, Tokyo, Japan

[21] Appl. No.: 895,969

[22] Filed: Apr. 13, 1978

[51] Int. Cl.[2] ..... A47F 3/00; H01H 47/00

[52] U.S. Cl. ..... 312/114; 312/304; 292/144; 361/171; 292/DIG. 46

[58] Field of Search ..... 312/114, 118, 304; 292/144, DIG. 46; 361/171

[56] References Cited

U.S. PATENT DOCUMENTS

| | | | |
|---|---|---|---|
| 1,907,625 | 5/1933 | Vogt | 292/DIG. 46 |
| 2,735,739 | 2/1956 | Patriarca | 312/114 |
| 3,094,861 | 6/1963 | Sayles | 292/DIG. 46 |
| 3,765,709 | 10/1973 | Van Wyck | 292/144 |
| 3,795,417 | 3/1974 | Cohen | 292/144 |
| 4,053,939 | 10/1977 | Makauchi et al. | 292/144 |

FOREIGN PATENT DOCUMENTS

| | | | |
|---|---|---|---|
| 650765 | 10/1962 | Canada | 292/DIG. 46 |
| 668261 | 8/1963 | Canada | 292/DIG. 46 |

*Primary Examiner*—Victor N. Sakran
*Attorney, Agent, or Firm*—Koda and Androlia

[57] ABSTRACT

A show case for displacing articles of commerce having an electronic lock and partially open in the front side for slidably receiving a pair of sliding doors which are adapted to overlap at their inner edges when the doors are in the closed position, said doors having holes at their inner edges adapted to align with each other when the doors are the closed position and said electronic lock including a solenoid in a position corresponding to the position of said inner edges of the doors in the closed position, a lock pin movable between the retracted position in which the lock pin is received in the solenoid and the extended position in which the lock pin is received in the holes in the doors in the closed position, a receiver adapted to receive radio waves from an external source, door closing detection means and a solenoid drive circuit electronically connected to said receiver though a timer for driving said lock pin to the retracted position upon receipt of the output signal from said receiver and also connected to said door closing detection means through a timer for driving the lock pin to the extended position in response to the detection of the closing of said doors by door closing detection means.

7 Claims, 4 Drawing Figures

SHOW CASE

BACKGROUND OF THE INVENTION

This invention relates to a show case for displaying articles of commerce such as valuable and high class articles and more particularly, to a show case for displaying such articles of commerce having an electronic lock which is normally adapted to hold the doors of the show case in the closed position and unlock the show case doors when the articles of commerce contained in the case are to be taken out thereof.

There have been proposed and practically employed a variety of show cases provided with locks for displaying articles of commerce and most of the conventional show cases of the type are adapted to be locked or unlocked by the employment of a particular key. However, in such a conventional show case, it encounters difficultites in finding the key hole into which the key is adapted to be inserted when the show case is placed in the dark environment. And the so-called digital dial type show case has been also known in the art, but the show case has the disadvantage that the user has to memory the proper key number for unlocking the show case. Any one of the two types of show cases having the locks referred to hereinabove has to be manually unlocked each time the articles of commerce being displayed therein are taken out of the show case when requested by potential buyers and then locked. However, such unlocking and locking would give unpleasantness to the buyers.

Furthermore, the conventional show cases of the type referred to hereinabove present the inconvenience that the person in charge of the show case must personally go to the place where the key is kept to unlock and lock the show case. That is, the key insertion type show case has the possibility that the key is easily reproduced by a third party and the digital dial type show case is relatively easily unlocked to thereby increase the possibility of theft.

SUMMARY OF THE INVENTION

Therefore, one important purpose of the present invention is to provide a show case which can effectively eliminate the disadvantages inherent in the conventional show cases referred to hereinabove.

Another object of the present invention is to provide a show case for displaying articles of commerce having an electronic lock which utilizes radio waves while eliminating the use of any key.

Another object of the present invention is to provide a show case for displaying articles of commerce having an electronic lock which can be unlocked by means of an unlocking means positioned remote from the show case body itself.

Another object of the present invention is to provide a show case for displaying articles of commerce having an electronic lock which can be automatically locked by sliding the doors of the show case body.

A further object of the present invention is to provide a show case for displaying articles of commerce having an electronic lock which can be instantly unlocked by operating a receiver in the circuit of the lock.

According to the present invention, these objects can be attained by the provision of a rectangular transparent show case having the top, bottom, opposite ends and rear side which are closed and the front side an upper portion of which is open and including a pair of sliding doors received in said open upper portion of the front side and provided at the inner edges with holes adapted to align with each other when said doors are in the closed position and a hollow display stand extending across the interior of said case for supporting articles of commerce thereon, which is characterized by the provision of an electronic lock for locking and unlocking said doors including a solenoid provided in said display stand in a position corresponding to the position of said holes when the doors are in the closed position, a lock pin movable between the retracted position in which said lock pin is received in said solenoid and the extended position in which said lock pin is received in said holes in the doors in the closed position of the doors, a receiver for receiving radio waves from an external source, door closing detection means, and a solenoid drive circuit electronically connected to said receiver for driving said lock pin to the retracted position upon receipt of the output signal from said receiver and also connected to said door closing detection means through a timer for driving the lock pin to the extended position in response to the detection of the closing of said doors by door detection means.

BRIEF DESCRIPTION OF THE DRAWINGS

The accompanying drawings show one preferred embodiment of show case constructed in accordance with the present invention and in which.

PREFERRED EMBODIMENT OF THE INVENTION

Figure 1:
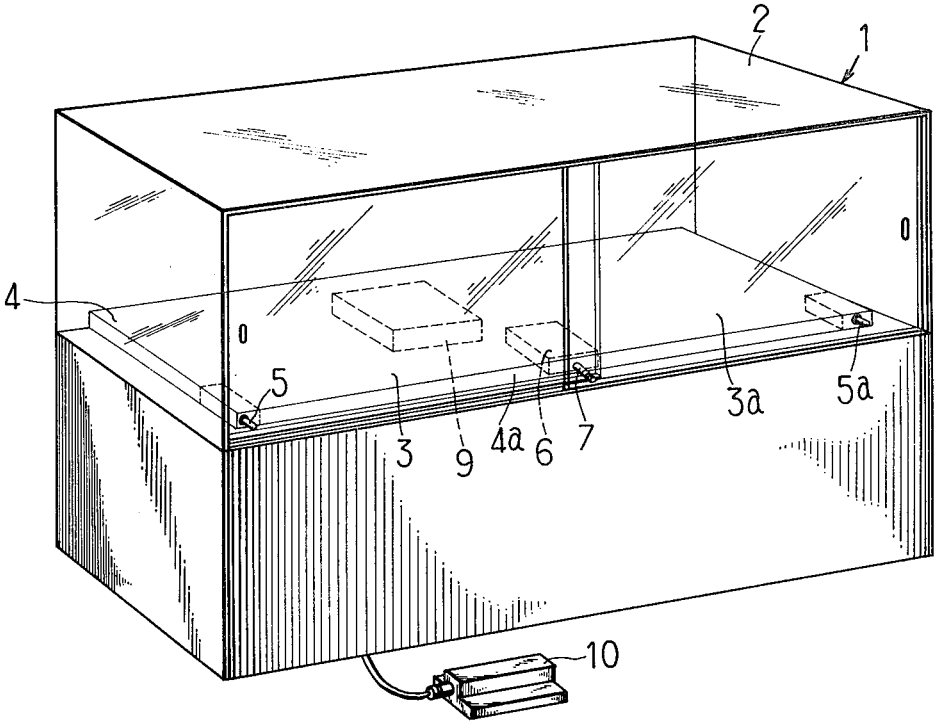
FIG. 1 is an isometrically perspective view of said embodiment of show case.
Figure 2:
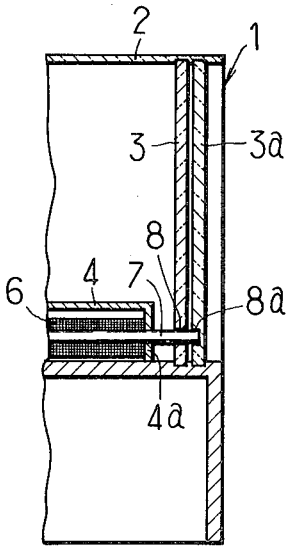
FIG. 2 is a fragmentary end elevational view in cross-section of said show case showing the case in its locked position.
Figure 3:
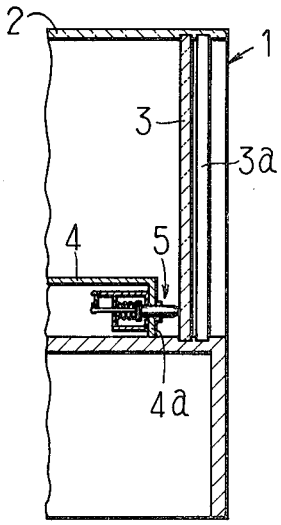
FIG. 3 is a fragmentary end elevational view in cross-section of said show case especially showing one of the microswitches in the electronic lock incorporated in the show case.

The present invention will be now described referring to the accompanying drawings which show the preferred embodiment of show case in which the principle of the present invention is incorporated. First, referring to FIGS. 1 through 3, in these Figures, reference numeral 1 generally denotes the show case and the show case generally comprises a rectangular case body 2 formed of transparent glass, for example. The case body 2 has the top, bottom, opposite ends and rear side which are closed and the front side an upper portion of which is open. The open upper portion of the front side of the case body 2 has a pair of sliding doors 3, **3*a* slidably received therein. As in the case of the conventional sliding door arrangement, the doors 3,3*a*** are adapted to overlap one on the other at their inner edges when the doors are in the closed position.

A hollow stepped display stand 4 extends horizontally across the interior of the case body 2 in a position of the height of the body to divide the interior of the body into the upper display portion and the lower support portion. The front side of the stepped display stand 4 is offset to provide a shoulder **4*a* which includes an upright portion and a horizontal portion and the upper surface of the shoulder horizontal portion is provided at the front edge area thereof with a pair of parallel grooves (not shown) in which the lower ends of the sliding doors 3, 3***a* are slidably received.

The undersurface of the top of the body 2 is also provided at the front edge area thereof with a pair of similar parallel grooves (not shown) in which the upper ends of the sliding doors are slidably received. A pair of microswitch-type selector switches 5, 5*a* are provided on the upright portion of the display stand shoulder 4*a* at the opposite ends thereof projecting outwardly of the shoulder portion and a solenoid 6 is provided in a substantially center position in the length of the display stand 4 where the overlapping inner edges of the sliding doors 3, 3*a* are positioned when they are in the closed position. A lock pin 7 is horizontally disposed in the solenoid 6 for slidable movement between the extended and retracted positions relative to the solenoid. The inner edges of the sliding doors 3, 3*a* are provided with a through hole 8 and a hole 8*a*, respectively, which are adapted to align with each other when the doors are in the closed position so that the aligned holes 8, 8*a* receive the lock pin 7 therein when the pin in its extended or door locking position to thereby lock the doors 3, 3*a*.

The sliding doors 3, 3*a* are unlocked when the lock pin is retracted from the aligned holes 8, 8*a* into the solenoid 6.

The lock pin 7 is extended from and retracted into the solenoid 6 by an electronic lock provided within the display stand 4 for locking and unlocking the sliding doors. The electronic lock will be now described referring to FIG. 4. As shown in this Figure, the electronic lock generally comprises a receiver 9 adapted to receive radio waves having a particular frequency from a small-type transmitter (not shown) provided in the display stand, a solenoid drive circuit 12 connected to the receiver 9 through a timer 11 which is in turn connected to a mat type selector switch 10 and the above-mentioned door closing detection switches or microswitch type selector switches 5, 5*a* connected to the solenoid drive circuit 12 through a timer 13.

The solenoid drive circuit 12 includes an unlocking solenoid 12*a* and a locking solenoid 12*b*. The unlocking solenoid 12*a* is adapted to be energized when the output current from the receiver 9 flows through the solenoid drive circuit 12 to thereby retract the lock pin 7 from the extended position in the aligned holes 8, 8*a* in the closed position of the doors 3, 3*a* into the solenoid 6. The locking solenoid 12*b* is adapted to be energized when the door closing detection switches 5, 5*a* are shifted to the ON position to extend the lock pin 7 from the retracted position in the solenoid 6.

The timer 11 associated with the selector switch 10 is operated when the selector switch 10 shifts to the ON position to thereby maintain the receiver 9 and solenoid drive circuit 12 in their connected condition for the time period of 5 seconds. During the receiver 9 and solenoid drive circuit 12 are being maintained in their connected condition, the receiver 9 receives radio waves from the transmitter to allow electric current to flow through the solenoid drive circuit 12 to thereby energize the unlocking solenoid 12*a*.

Figure 4:
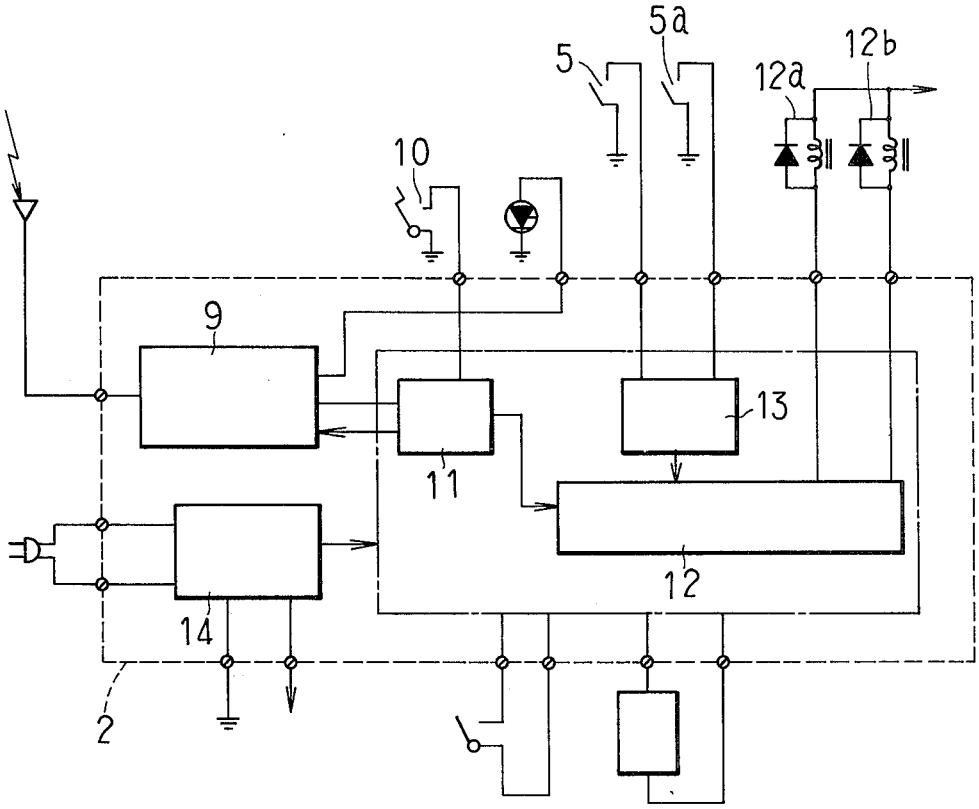
FIG. 4 is a diagrammatic view of the circuit of said electronic lock.

Furthermore, the timer 13 associated with the door closing detection switches 5, 5*a* is operated when the door closing detection switches 5, 5*a* are shifted to the ON position with the sliding doors 3, 3*a* in the closed position to energize the locking solenoid 12*b* for the time period of 1 second and after the energizing time period has passed, the timer 13 deenergizes the locking solenoid 12*b* even when the door closing detection switches 5, 5*a* are in the ON position. In FIG. 4, reference numeral 14 denotes a power source which is grounded.

The door locking and unlocking operation by the electronic lock incorporated in the show case of the present invention will be now described.

In order to unlock the sliding doors 3, 3*a*, the foot pedal switch or selector switch 10 is stepped down to shift the switch to the ON position whereupon the timer 10 is operated to connect between the receiver 9 and solenoid drive circuit 12 for the time period of 5 seconds. While the receiver 9 and solenoid drive circuit 12 being connected to each other, the receiver 9 receives radio waves from the transmitter to allow electric current to flow from the receiver 9 to the solenoid drive circuit 12 to thereby energize the unlocking solenoid 12*a* whereupon the lock pin 7 is retracted from the extended position in the aligned holes 8, 8*a* in the sliding doors 3, 3*a* into the retracted position within the solenoid 6 to thereby unlock the sliding doors 3, 3*a*. The door unlocking solenoid 12*a* is deenergized after the set time period of 5 seconds for energizing has passed and the lock pin 7 is maintained in the retracted position within the solenoid 6 until the next door opening operation is resumed.

With the lock pin 7 maintained in the retracted position within the solenoid 6, the sliding doors 3, 3*a* are ready for opening. When the sliding doors 3, 3*a* are to be closed, the closing doors 3, 3*a* depress the switch buttons on the microswitches 5, 5*a* down to shift the switches to the ON position whereupon the timer 13 operates to energize the door locking solenoid 12*b* for the time period of 1 second to thereby extend the lock pin 7 from the retracted position within the solenoid 6 into the now aligned holes 8, 8*a* in the sliding doors 3, 3*a* to lock the doors. At this time, although the door locking solenoid is deenergized after the set time period of 1 second for energization, the lock pin is maintained in its extended position within the aligned holes 8, 8*a* in the sliding doors 3, 3*a*. Subsequent unlocking and locking operations can be performed by repeating the above-mentioned procedure.

While only one embodiment of the invention has been shown and described in detail, it will be understood that the same is for illustration purpose only and not to be taken as a definition of the invention, reference being had for this purpose to the appended claims.

What is claimed is:

1. In a rectangular transparent show case having the top, bottom, opposite ends and rear side which are closed and the front side an upper portion of which is open and including a pair of sliding doors received in said open upper portion of the front side and provided at the inner edges with holes adapted to align with each other when said doors are in the closed position and hollow display stand extending across the interior of said case for supporting articles of commerce thereon, characterized by the provision of an electronic circuit including a selector switch and an electronic lock for locking and unlocking said doors including a solenoid provided in said display stand in a position corresponding to the position of said holes when the doors are in the closed position, a lock pin movable between the retracted position in which said lock pin is received in said solenoid and the extended position in which said lock pin is received in said holes in the doors in the closed position of the doors, a receiver for receiving radio waves from an external source, door closing detection means and a solenoid drive circuit electronically connected to said receiver for driving said lock pin to the retracted position upon receipt of the output signal from said receiver and also connected to said door closing detection means through a timer for driving the lock pin to the extended position in response to the detection of the closing of said doors by door detection means.

2. The show case as set forth in claim 1, in which said solenoid drive circuit includes an unlocking solenoid for retracting said lock pin from the extended position to the retracted position upon receipt of the output signal from said receiver and a locking solenoid for extending said lock pin from the retracted position to the extended position for a predetermined time period by said timer in response to the shifting of said door closing detection means.

3. The show case as set forth in claim 1, said selector switch disposed through a second timer between said receiver and solenoid drive circuit and after the operation of said selector switch, said receiver and solenoid drive circuit are maintained in the connected condition for a predetermined time period by said second timer.

4. The show case as set forth in claim 2, in which said hollow display stand is offset on the front side thereof adjacent to said doors to provide a shoulder and said door closing detection means includes a pair of door closing detection switches provided on said shoulder of the display stand at the opposite ends of the shoulder.

5. The show case as set forth in claim 1, in which said selector switch is foot pedal switch which is positioned externally of the body of said show case.

6. The show case as set forth in claim 1, in which said position of the solenoid is a substantially center position in the length of the display stand.

7. The show case as set forth in claim 1, in which one of said holes in the doors is a through hole provided in one of the doors.

* * * * *

UNITED STATES PATENT AND TRADEMARK OFFICE

CERTIFICATE OF CORRECTION

PATENT NO. : 4,141,610

DATED : February 27, 1979

INVENTOR(S) : SHOICHIRO ANDO

It is certified that error appears in the above-identified patent and that said Letters Patent are hereby corrected as shown below:

On the cover sheet of the Patent on the line after "[22] Filed: Apr. 13, 1978" insert:
--[30] Foreign Application Priority Data
Apr. 18, 1977 Japan..... 52-47706

Signed and Sealed this

*Eighteenth* Day of *September 1979*

[SEAL]

*Attest:*

*Attesting Officer*

LUTRELLE F. PARKER

*Acting Commissioner of Patents and Trademarks*